US006572713B2

(12) United States Patent
Kucharczyk et al.

(10) Patent No.: US 6,572,713 B2
(45) Date of Patent: Jun. 3, 2003

(54) GRAIN-REFINED AUSTENITIC MANGANESE STEEL CASTING HAVING MICROADDITIONS OF VANADIUM AND TITANIUM AND METHOD OF MANUFACTURING

(75) Inventors: Jerzy W. Kucharczyk, Carlisle, PA (US); Karl R. Funk, Myerstown, PA (US); Bernd Kos, Leoben (AT)

(73) Assignee: The Frog Switch and Manufacturing Company, Carlisle, PA (US)

( * ) Notice: Subject to any disclaimer, the term of this patent is extended or adjusted under 35 U.S.C. 154(b) by 0 days.

(21) Appl. No.: 09/932,155

(22) Filed: Aug. 17, 2001

(65) Prior Publication Data

US 2002/0048529 A1 Apr. 25, 2002

Related U.S. Application Data

(60) Provisional application No. 60/241,819, filed on Oct. 19, 2000.

(51) Int. Cl.[7] ..... C22C 38/04

(52) U.S. Cl. ..... 148/329; 420/75; 420/99; 420/129

(58) Field of Search ..... 420/99, 100, 101, 420/75, 73, 74, 129; 148/329

(56) References Cited

U.S. PATENT DOCUMENTS

| | | | | |
|---|---|---|---|---|
| 4,130,418 A | 12/1978 | Hartvig | 75/126 B |
| 4,157,258 A | 6/1979 | Philip et al. | 75/124 |
| 4,302,248 A | 11/1981 | Kasamatsu et al. | 75/128 |
| 4,377,422 A | 3/1983 | Mackay et al. | 148/137 |
| 4,425,169 A | 1/1984 | Subramanyam et al. | 148/137 |
| 4,512,804 A | 4/1985 | Kos | 75/123 |
| 4,531,974 A | 7/1985 | Kos | 75/123 |
| 4,612,067 A | 9/1986 | Larson et al. | 148/329 |
| 4,629,504 A | 12/1986 | Koike et al. | 420/38 |
| 4,788,034 A | 11/1988 | Brandis et al. | 420/75 |
| 4,820,486 A | 4/1989 | Shimogori et al. | 420/108 |

(List continued on next page.)

FOREIGN PATENT DOCUMENTS

| | | | |
|---|---|---|---|
| CA | 1232780 | 2/1988 | C22C/38/04 |
| SU | 1108129 | 8/1984 | |

*Primary Examiner*—Deborah Yee
(74) *Attorney, Agent, or Firm*—McNees Wallace & Nurick; Carmen Santa Maria

(57) ABSTRACT

An austenitic manganese steel microalloyed with nitrogen, vanadium and titanium used for castings such as mantles, bowls and jaws manufactured as wear components of crushers in the mining and aggregate industries, hammers used in scrap shredders, frogs and switches used in railway crossings and buckets and track shoes used in mining power shovels. These novel compositions exhibit a fine grain size having carbonitride precipitates that result in castings having a wear life 20–70% longer than prior art castings. The austenitic manganese steel includes, in weight percentages, the following: about 11.0% to 24.0% manganese, about 1.0% to 1.4% carbon, up to about 1% silicon, up to about 1.9% chromium, up to about 0.25% nickel, up to about 1.0% molybdenum, up to about 0.2% aluminum, up to about 0.25% copper, phosphorus and sulfur present as impurities in amounts of about 0.07% max and about 0.06% max. respectively, microalloying additions of titanium in the amounts of about 0.020–0.070%, optionally, microalloying additions of niobium in amounts from about 0.020–0.070%, microalloying additions of vanadium in amounts from about 0.020–0.070%, nitrogen in amounts from about 100 to 1000 ppm, and such that the total amount of the microalloying additions of titanium+niobium+vanadium+nitrogen is no less than about 0.05% and no greater than about 0.22%, the ratio of carbon to microalloying additions being in the range of about 10:1–25:1, and the balance of the alloy being essentially iron, the alloy being characterized by a substantial absence of zirconium and the presence of titanium carbonitride precipitates.

35 Claims, 3 Drawing Sheets

U.S. PATENT DOCUMENTS

| | | | | |
|---|---|---|---|---|
| 4,855,105 | A | 8/1989 | Svidunovich et al. | 420/75 |
| 4,875,933 | A | 10/1989 | Wan | 75/10.17 |
| 4,886,640 | A | 12/1989 | Garner, Jr. et al. | 420/111 |
| 4,923,675 | A | 5/1990 | Svidunovich et al. | 420/129 |
| 5,061,441 | A | 10/1991 | Aoki et al. | 420/109 |
| 5,069,871 | A | 12/1991 | Fuller | 420/72 |
| 5,601,782 | A | 2/1997 | Kunioka et al. | 420/74 |
| 5,695,576 | A | 12/1997 | Beguinot | 148/328 |
| 5,820,819 | A | 10/1998 | Tanabe et al. | 420/112 |
| 5,888,450 | A | 3/1999 | Finkl et al. | 420/109 |
| 5,891,388 | A | 4/1999 | Baik et al. | 420/72 |
| 5,910,285 | A | 6/1999 | Zhao | 420/72 |

GRAIN-REFINED AUSTENITIC MANGANESE STEEL CASTING HAVING MICROADDITIONS OF VANADIUM AND TITANIUM AND METHOD OF MANUFACTURING

CROSS-REFERENCE TO RELATED APPLICATIONS

This application claims the benefit of U.S. Provisional Application No. 60/241,819 filed Oct. 19, 2000.

FIELD OF THE INVENTION

The present invention is directed to austenitic manganese steel castings having improved wear resistance resulting from grain refinement due to the additions of vanadium, titanium and nitrogen, and methods of producing this steel in applications such as, for example, casting wear liners for cone and jaw crushers, hammers for scrap shredders, frogs and switches for railway tracks and other castings required to possess gouging, abrasion and impact resistance.

BACKGROUND OF THE INVENTION

Austenitic manganese steels having a wide range of applications are well known. Such steels include alloying additions of manganese (Mn) in amounts of 5–25% by weight and carbon (C) content in the range of about 0.7–2.0% by weight. The most characteristic type is the austenitic Mn-steel containing 12–14% Mn and 1.2–1.4% C, which was invented in 1882 by Robert Hadfield and to this day often is referred to as Hadfield steel. These steels combine high toughness with ductility and high work-hardenability which makes them a material of choice for wear components of machinery and equipment used in mining, quarrying, earthmoving, dredging and the railroads, to name the most significant fields of application.

One example of such an austenitic manganese steel is set forth in U.S. Pat. Nos. 4,512,804 and 4,531,974 to Kos. These patents are directed to a work-hardenable austenitic manganese steel having carbon to manganese ratios between 1:4 and 1:14 and microalloyed with 0–0.20% by weight of titanium (Ti), 0–0.05% by weight zirconium (Zr) and 0–0.05% by weight vanadium (V), provided that the sum of Ti+Zr is in the range of 0.003–0.05 weight percent. These alloying elements are added to refine the grain size of the casting, which grain size can be further refined by the addition of small amounts of boron (B). Alternatively, Ti in the range of 0.01–0.025% or Ti+Zr+V in the range of 0.002 to 0.05 when microalloyed with the austenitic steel produced castings having refined grain size. These alloying elements, when added to the casting ladle after a deoxidation process, have produced a manganese steel with exceptional toughness. The alloys set forth in these patents obtain their grain refinement by the use of microalloying additions of zirconium and titanium, while vanadium is an optional element.

Another alloy is set forth in Canadian Patent Application No. CA 1221560 to Kos. This alloy is similar to the alloys set forth above, but allows up to 0.20% titanium, in addition to optional amounts of vanadium and zirconium. The Canadian application broadly identifies the compositions set forth in the earlier U.S. patents, but fails to appreciate the benefits that can be achieved by the interaction of several key elements when closely controlled within relatively tight limits and when processed to maximize their effect on the product.

While each of the above-described alloys represents advancement in the art resulting from the careful control of grain size in large castings, further advancements are sought to improve efficiency and reduce overall costs by improving the wear resistance of these castings by continuing the control of grain size, and by making further improvements.

What is needed is an alloy that can extend the mean life of wear components subjected to gouging, abrasion and/or impact like the one that occurs in rock crushers, mining power shovels, scrap shredders, frogs and switches used in railroad crossings and others.

SUMMARY OF THE INVENTION

The present invention is an austenitic manganese steel microalloyed with nitrogen, vanadium and titanium, used for castings such as mantles, bowls and jaws used as wear components in the mining and aggregate industries, hammers used in scrap shredders, buckets and track shoes used in mining power shovels, frogs and switches used in railroad crossings. The compositions made in accordance with the present invention exhibit a fine grain size having carbonitride precipitates, and titanium-containing carbonitride precipitates, that result in castings having a wear life 20–70% longer than prior art castings.

The austenitic manganese steel of the present invention is comprised, in weight percentages, of the following: about 11.0% to 24.0% manganese, about 1.0% to 1.4% carbon, up to about 1% silicon, up to about 1.9% chromium, up to about 0.25% nickel, up to about 1.0% molybdenum, up to about 0.2% aluminum, up to about 0.25% copper, phosphorus and sulfur present as impurities in amounts of about 0.07% max. and about 0.06% max., respectively, microalloying additions of titanium in the amounts of about 0.020–0.70%, optionally, microalloying additions of niobium in amounts from about 0.020–0.70%, microalloying additions of vanadium in amounts from about 0.020–0.70%, nitrogen in amounts from about 100 to 1000 ppm, and such that the total amount of the microalloying additions of titanium+niobium+vanadium+nitrogen is no less than about 0.05% and no greater than about 0.22%, the ratio of carbon to microalloying additions being in the range of about 10:1–25:1, and the balance of the alloy being essentially iron, the alloy being characterized by a substantial absence of zirconium and the presence of titanium-containing precipitates, for example, titanium carbonitride precipitates. The alloy otherwise conforms to ASTM Standard A128/A128M-93.

While the alloy of the present invention may contain small amounts of zirconium, the amounts of zirconium present must be, on an atomic level, less than the amount of nitrogen.

Small deviations of the chemistry from the relatively tight ranges set forth above result in a failure to achieve the desired grain size with a subsequent loss of the beneficial effects of improved wear resistance exhibited by the alloy of the present invention.

The alloy of the present invention is very sensitive to processing. The alloy of the present invention is melted in an electric arc furnace or an induction furnace. In order to obtain the beneficial effects of the microalloying elements, it is necessary to deoxidize the molten metal prior to microalloying.

Conditions in the molten steel must promote the formation of the carbonitride precipitates, including, titanium carbonitride precipitates. It is known that failure to properly deoxidize the molten metal results in a loss of titanium as $TiO_2$. Furthermore, vanadium can be added to the furnace or ladle, although titanium and carbide-forming elements should be added to the molten metal as it is transferred from the furnace to a pouring ladle in order to obtain proper distribution of these elements in the molten bath. In practice vanadium, titanium, optional niobium, and any other carbide-forming elements, are added to the molten metal during the metal transfer from the furnace to the pouring ladle. Alternatively, the proper distribution can be achieved by agitation of the molten metal in the pouring ladle. The pouring temperature of the molten metal must be carefully controlled in accordance with good foundry practice. Castings made of an alloy processed in accordance with the present invention has a refined grain size of #1 or finer as determined in accordance with ASTM standard E-112 in test bars having a 4" cross-section. As used herein, all references to grain size, and specifically to ASTM E-112#1 or finer grain size, is with reference to the average grain size measured in a test bar having a 4" cross-section. As recognized by those skilled in the art, different cross sections can be expected to display different grain size results. Castings made in accordance with the present invention are expected to display an average grain size that is finer than castings not made in accordance with the present invention.

An advantage of castings having compositions and processed in accordance with the present invention is that they have markedly improved wear properties. Thus, the castings used in applications in which wear is a consideration, such as mantels, bowl liners, jaws, hammers, dipper buckets, frogs and other similar parts, have a decided advantage when resistance to wear is increased. The major benefits include longer mean life between replacements. This in turn means lower operating costs, for an increase in mean life between replacements meaning fewer replacement parts, lower labor costs as less labor time is spent replacing worn parts and less down time. These benefits are significant even if the cost of the casting having improved resistance to wear is slightly higher than castings not exhibiting such improvements.

Another advantage of the present invention is that the alloy of the present invention can be made using existing equipment, provided that the processing controls required by the present invention are implemented.

Still another advantage of the present invention is that increased wear life provided by the castings of the present invention will ultimately result in a conservation of resources. Since the life of each casting is longer, less energy is expended to produce and transport fewer castings, and fewer pollutants are released to the atmosphere.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
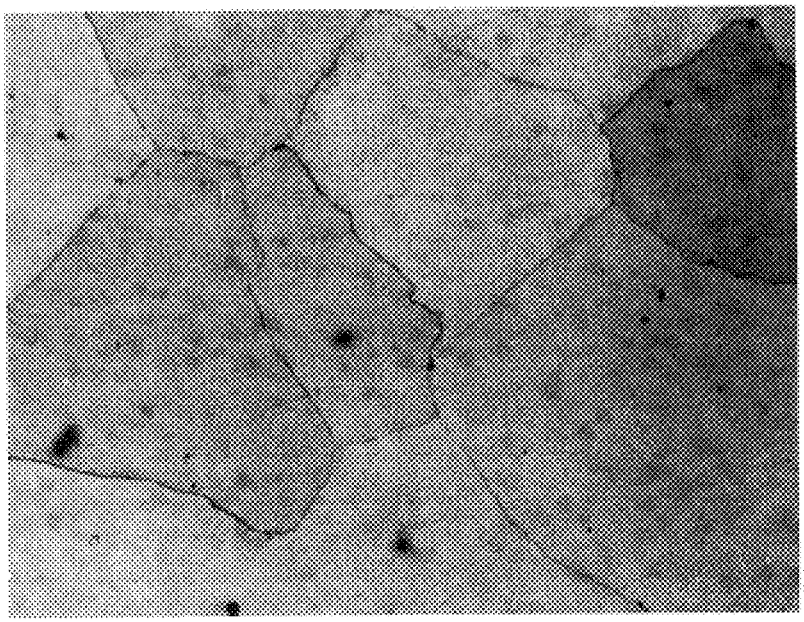
FIG. 1 is a photomicrograph at 100 magnification of a casting from heat #3–14, made in accordance with the present invention.

The present invention sets forth improvements for castings used in the aggregate and mining industries, scrap processing industry as well as castings utilized in the railway industry. These castings are referred to as mantles, bowls, jaws, dipper buckets, crawler shoes, hammers, impact bars, frogs, switches and the like.

These castings have traditionally been made of austenitic manganese steel, which has good wear properties. Improvements have been made to the composition and processing of this type of steel to enhance its wear properties. The present invention comprises a refinement to the composition and to the method of producing the composition that produces an austenitic manganese steel that has a refined grain size and improved wear resistance superior to castings made even in accordance with recent improvements. In conjunction with the present composition and fine grain size, the present alloy also includes uniformly distributed, fine, carbonitride and titanium-containing precipitates, in the preferred embodiment complex titanium carbonitride precipitates. These fine, uniformly distributed precipitates contribute to the fine grain structure over a narrow range of alloying elements and occur only when the steel is properly processed. The composition of the alloy of the present invention in terms of its constituent elements and the effects of these constituent elements are set forth below. Alloys made in accordance with the present invention have demonstrated improvements in life of up to 70%, typically in the range of 30–40%. Unless otherwise specified, the composition of the present alloy and its constituent elements are provided in weight percent. The range of each of the alloying elements is set forth below, the balance of the alloy being essentially iron (Fe) and small amounts of incidental impurities and elements which in character and/or amount do not affect the advantageous aspects of the alloy.

In a preferred embodiment, the austenitic manganese steel of the present invention is comprised, in weight percent, of the following: about 11.0% to 14.0% manganese and more preferably about 12.5% to 13.5% manganese, about 1.0% to 1.4% carbon and more preferably about 1.05% to about 1.35% carbon,, up to about 1% silicon (Si), up to about 1.9% chromium (Cr), up to about 0.25% nickel (Ni), up to about 1.0% molybdenum (Mo), up to about 0.2% aluminum (Al), up to about 0.25% copper (Cu), phosphorus (P) and sulfur (S) present as impurities in amounts of about 0.07% max. and about 0.06% max., respectively, microalloying additions of optional carbide forming elements, such as niobium (Nb), in amounts of about 0.035–0.060%, microalloying additions of titanium in amounts of about 0.035–0.060%, microalloying additions of vanadium in amounts from about 0.035–0.060%, and nitrogen (N) in amounts from about 100 to about 1000 ppm, the total amount of the microalloying additions, which include the optional carbide forming elements+vanadium+titanium+nitrogen is no less than about 0.08% and no greater than about 0.22%, the ratio of carbon to microalloying additions being in the range of about 10.7:1–16.6:1, and the balance of the alloy being essentially iron and incidental impurities. In the preferred embodiment, the alloy of the present invention does not include zirconium. In alternative embodiments, a small amount of zirconium may be present as long as, on an atomic level, there is an excess of nitrogen over zirconium in an amount of about 100 ppm to about 1000 ppm; that is, the amount of nitrogen minus the amount of zirconium on an atomic basis is greater than about 100 ppm to about 1000 ppm.

The alloy of the present invention is characterized by a fine grain size of #1 and finer, preferably #2 and finer as determined in accordance with ASTM Standard E-112, and the presence of fine carbonitride precipitates and titanium containing precipitates such as complex titanium carbonitride precipitates. While Zr may be present, it is preferred that no Zr be added, as, Zr in excess of N can inhibit the formation of Ti-containing precipitates as combinations of Zr and N are believed to preferentially form over Ti-containing precipitates. The titanium-containing precipitates, titanium carbonitrides for example, are believed to play a key role in the outcome of the attempted grain refinement and improved wear resistance of the alloy of the present invention.

V is a strong carbide former, which contributes to grain refinement by inhibiting grain growth during the solidification process, which can result in extensive periods of time at elevated temperatures for large castings such as the mantels and bowl liners that form crushers. Some V may be present in the complex carbonitrides formed by the present invention. However, only small amounts of V should be included, in the range of about 0.020–0.70%, preferably in the range of about 0.035–0.060% and most preferably in the range of about 0.04–0.06% as excessive V content results in decreasing toughness of the casting by contributing to the formation of coarse carbides. Additionally, once V is added to the alloy, it is difficult to remove, unlike other elements that can be removed relatively easily by processes such as oxidation, which is induced by an oxygen blow. It is therefore important not to exceed the maximum levels of V.

Ti is added primarily as an essential element in the formation of titanium-containing precipitates, preferably the complex titanium carbonitrides, which contributes to grain refinement, and apparently to improved wear resistance. It can also deoxidize the molten metal, if a prior deoxidation was inadequate or ineffective, as Ti combines with O to form $TiO_2$. Like V, it is added to the molten metal. Ti is also a carbide-forming element, and its inclusion in the present invention is believed to promote the formation of fine, complex titanium carbonitride precipitates in the alloy of the present invention. However, unlike V, Ti also readily combines with O, so that the amount of Ti available in the molten metal for formation of desirable precipitates can be modified by the presence of O. Before Ti is added to the molten alloy, it is fundamental to control the amount of O, as excess O in the presence of Ti result in the formation $TiO_2$, and the Ti levels will fall below the required amounts of about 0.020–0.70%, preferably about 0.035–0.060%, and most preferably in the range of about 0.040–0.060%. A casting not having the requisite amounts of free Ti will not form the desirable titanium precipitates and will not achieve the desired grain refinement and accompanying improved wear resistance.

Oxygen (O) is an important element that must be carefully controlled, as it is both desirable and undesirable. It is an important element during the melting and refining process, as it is used to eliminate undesirable detrimental elements that may be present in the steel by forming oxides. These undesirable detrimental elements may be present in the raw material stock that is melted during the manufacturing process. However, if not carefully controlled, it becomes undesirable as excess O forms oxides with desirable elements such as Mn, V and Si as well as with the important precipitation former and grain refiner, Ti. Although the oxides may be trapped in the casting during the pouring process, they typically form part of the slag as the less dense oxides float to the surface of the molten metal. If too much O is present in the casting during solidification, toughness is adversely affected as excess O tends to embrittle steel, which further exacerbates any problems caused by oxidation of Ti as $TiO_2$. In the present invention, the final amount of O present in the casting is controlled by proper deoxidation to the lowest residual possible in the alloy.

Al is added to substantially reduce the amount of O present in the casting to the maximum extent reasonably possible. Aluminum deoxidation immediately prior to the addition of titanium is an important operation in achieving the required results. The maximum allowable amount of residual Al in the alloy of the present invention is about 0.2%. The amount of Al added to the alloy of the present invention is carefully controlled so that O is substantially eliminated; yet a small amount, at least about 0.01% Al remains. This small amount of residual Al is believed to protect the alloy from loss of Ti as a result of oxygen gain after deoxidation. As the amount of residual Al is increased above about 0.2%, there is a loss of ductility. Other elements such as Ca, Ba, Si or combinations thereof may be used with Al or substituted for Al to accomplish a complex deoxidation, but Al is the preferred deoxidant.

Nitrogen (N) is an element that previously has been regarded as an undesirable tramp element or incidental impurity in austenitic manganese steels contributing to porosity. In has been the past practice to maintain tramp elements at the lowest possible level, even eliminating such tramp elements, if feasible. However, in the present invention, a certain amount of N is necessary. Contrary to these previous teachings, N up to a maximum of about 1000 ppm and preferably in the range of about 100–400 ppm, most preferably about 300 ppm, is required to contribute to the formation of very fine, uniformly distributed carbonitride precipitates, preferably titanium carbonitride precipitates, of the present invention that provides the uniform fine grain size that furnishes the exceptional wear resistance contributing to the long life of crushers and other parts made of the alloy of the present invention. N can be added to the melt by additions of nitrogen-bearing compounds such as nitrogen-bearing manganese. If the N is below the limits set forth by the present invention, these carbonitride precipitates either do not form or do not form in sufficient amount to provide the exceptional wear resistance found in the alloy of this invention. If the N content exceeds these limits, then undesirable gas defects can occur in the casting. Thus, it is critical to the success of the present invention to control nitrogen not as a tramp element as in past practice, but rather as an alloying element within very narrow limits, or the beneficial effects resulting from the formation of carbonitride precipitates either will not occur or will be overshadowed by undesirable gas defects.

Zr was intentionally omitted from the compositions tested in arriving at the present invention. Zr is believed to hinder the formation of vanadium nitrides, vanadium carbides, titanium nitrides and titanium carbides, as well as the complex carbonitrides of the present invention. The combination of Ti and V is a preferred combination for the formation of nitrides, carbides and carbonitrides.

Processing

The castings of the present invention were poured in a foundry using an electric arc furnace. It is believed that not only are the chemistry and resulting microstructure very important in achieving the improved wear resistance of the present invention, but the processing parameters and sequence are equally important.

An initial metal charge was carefully weighed out and added to the furnace. A single charge can weigh up to 13 tons in the furnace employed. As an example, an initial charge can include predetermined amounts of manganese steel scrap, low phosphorus steel scrap, ferro-alloy additions such as high carbon ferromanganese, low carbon manganese, silico-manganese and nitrogen-bearing alloys as required. The amounts of each of these components were adjusted during the melting and refinement process to achieve a calculated composition close to that desired in the final product. The charge was heated in the range of 2670°–2900° F. Slag additions of lime and coke breeze provided a protective covering for the molten metal. Before tapping the furnace, oxygen was blown into the molten metal. The oxygen injection, in addition to any beneficial effects in refining the molten alloy, induces agitation, which thoroughly mixes the alloying elements and melts any unmelted material at the bottom of the furnace.

After the oxygen blow, the molten metal was deoxidized by the addition of sufficient Al, about 10 lbs. of Al for a heat of about 12 tons. The Al used to deoxidize the metal combines with O to form $Al_2O_3$. A sample of the metal was then taken to determine the actual chemical composition of the metal. Any required adjustments to the chemistry, as determined from the sample, were made in the furnace prior to tapping. The temperature of the molten metal was adjusted as necessary. Slag was removed from the molten metal during transfer to a pouring ladle.

Next, preweighed microalloying additions of V and Ti, were inserted directly into the molten metal stream. The introduction of these microalloying additions into the stream of molten metal was critical to obtaining a properly grain-refined steel having improved wear resistance. The metal stream agitates the metal already in the ladle and assists in uniformly distributing and dispersing the Ti and V throughout the deoxidized molten metal. The V and Ti are added as ferro-vanadium and ferro-titanium. Lime is added to the ladle as necessary to form a protective slag. Optionally, a predetermined amount of aluminum may be added to the preheated ladle to deoxidize the steel and before about 40% of the steel is poured from the furnace, preferably after about 25–33% of the molten steel is poured, Another optional step entails adding CaSiBa compound as a substitute for Al or in addition to Al as the molten steel is poured from the furnace to the ladle, but before about 25% of the charge has been poured.

The molten metal is held in the ladle until the temperature is in a narrow range of about 2590–2660° F. (1420–1460° C.), preferably in the range of about 2625–2650° F., (1440–1455° C.) and most preferably about 2630° F. (1443° C.), at which time it is cast into molds of predetermined shape. The pouring temperature is important in the nucleation of the fine grains of the present invention.

After solidification of the castings, the castings were heat treated in accordance with ASTM 128, which is a standard solution annealing treatment followed by water quenching.

The formation of a substantially uniform distribution of complex titanium carbonitrides is important to the present invention. Titanium is a known nitride former that also can form carbides. Vanadium also possesses a strong affinity to nitrogen and carbon. It is believed that during solidification, these elements form stable nitrides, carbides and complex carbonitrides that serve as nucleation sites for the crystals. Thus, the uniform distribution of these elements in the molten metal is essential for formation of fine grains throughout the casting.

EXAMPLE 1

A heat of austenitic manganese steel identified as heat #3–14 was manufactured in accordance with the processing set forth above. The composition of the steel in weight percent, was as follows:

C—1.28%
Mn—12.64%
Si—0.63%
P—0.036%
S—0.002%
Cr—0.37%
Mo—0.10%
Cu—0.13%
Ni—0.12%
Al—0.042%
Ti—0.039%
V—0.059%
N—0.032% (320 ppm)

The average grain size of the alloy was determined to be in accordance with ASTM E-112#2 or finer in test bars having a 4" cross-section. Photomicrographs at 100× using a 4% Nital etch showing the grain size taken from a casting from this heat is provided in FIG. 1.

EXAMPLE 2

A heat of austenitic manganese steel identified as heat #4–1263 was manufactured in accordance with the processing set forth above. The castings made from this heat of material displayed a life increase of about 40%. The composition of the steel in weight percent, was as follows:

C—1.32%
Mn—13.54%
Si—0.68%
Cr—0.36%
Mo—0.08%
Ni—0.11%
Al×0.016%
Ti—0.027%
V—0.049%
N—0.031% (310 ppm)
P—0.028%
S—0.006%

Figure 2:
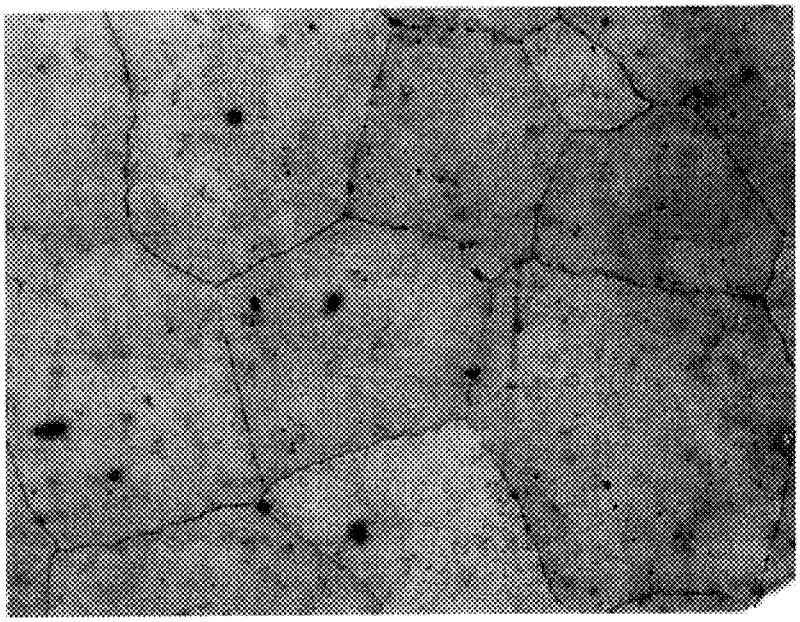
FIG. 2 is a photomicrograph at 100 magnification of a casting from heat #4–1263, made in accordance with the present invention.

The average grain size of the alloy was determined to be in accordance with ASTM E-112#2 or finer, based on test bars having a 4" cross-section. Photomicrographs at 100× using a 4% Nital etch showing the grain size taken from a casting from this heat is provided in FIG. 2.

EXAMPLE 3

A heat of austenitic manganese steel identified as heat #4–1265 was manufactured in accordance with the processing set forth above. The castings made from this heat of material displayed a life increase of about 33%. The composition of the steel in weight percent, was as follows:

C—1.22%
Mn—12.34%
Si—0.62%

Cr—0.65%

MO—0.1%

Ni—0.098%

Al—0.039%

Ti—0.030%

V—0.044%

N—0.026% (260 ppm)

P—0.028%

S—0.006%

Figure 3:
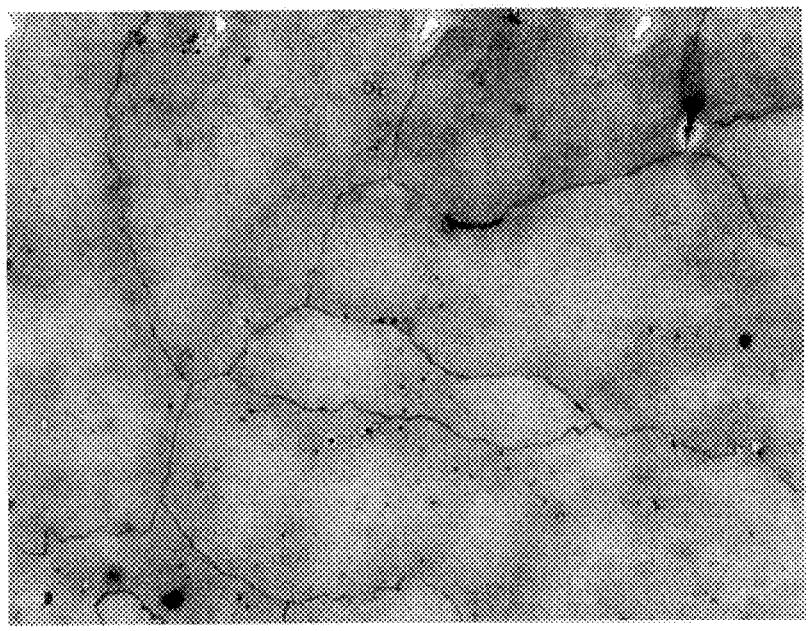
FIG. 3 is a photomicrograph at 100 magnification of a casting from heat #4–1265, made in accordance with the present invention.

The average grain size of the alloy was determined to be in accordance with ASTM E-112#2 or finer, based on test bars having a 4" cross section. Photomicrographs at 100× using a 4% Nital etch showing the grain size taken from a casting from this heat is provided in FIG. 3.

EXAMPLE 4

A heat of austenitic manganese steel identified as heat #4–1259 was manufactured in accordance with the processing set forth above. The castings made from this heat of material displayed a life increase of about 40%. The composition of the steel in weight percent, was as follows:

C—1.33%

Mn—13.81%

Si—0.74%

Cr—0.30%

Mo—0.10%

Ni—0.10%

Al—0.043%

Ti—0.033%

V—0.048%

N—0.036% (360 ppm)

P—0.027%

S—0.007%

Figure 4:
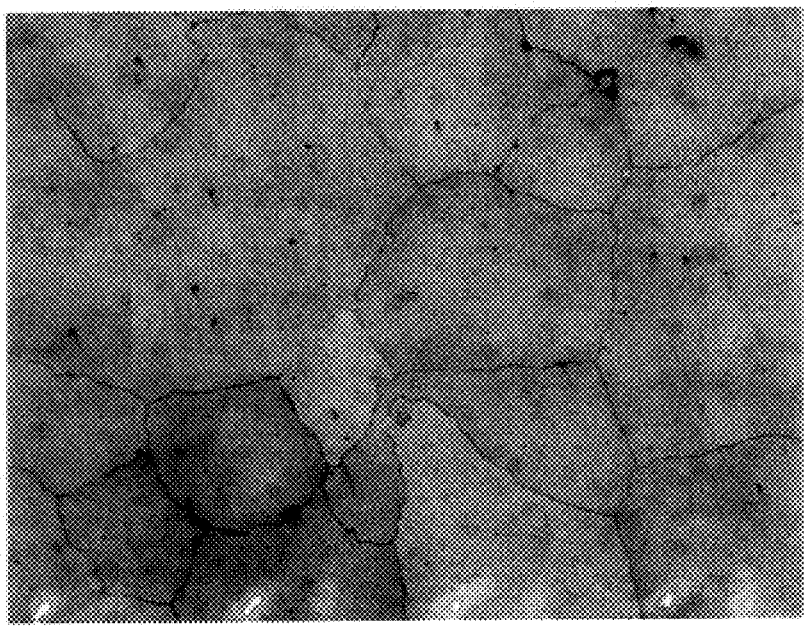
FIG. 4 is a photomicrograph of a casting at 100 magnification from heat #11–1259, made in accordance with the present invention.

The average grain size of the alloy was determined to be in accordance with ASTM E-112#2 or finer, based on test bars having a 4" cross-section. Photomicrographs at 100× using a 4% Nital etch showing the grain size taken from a casting from this heat is provided in FIG. 4.

Figure 5:
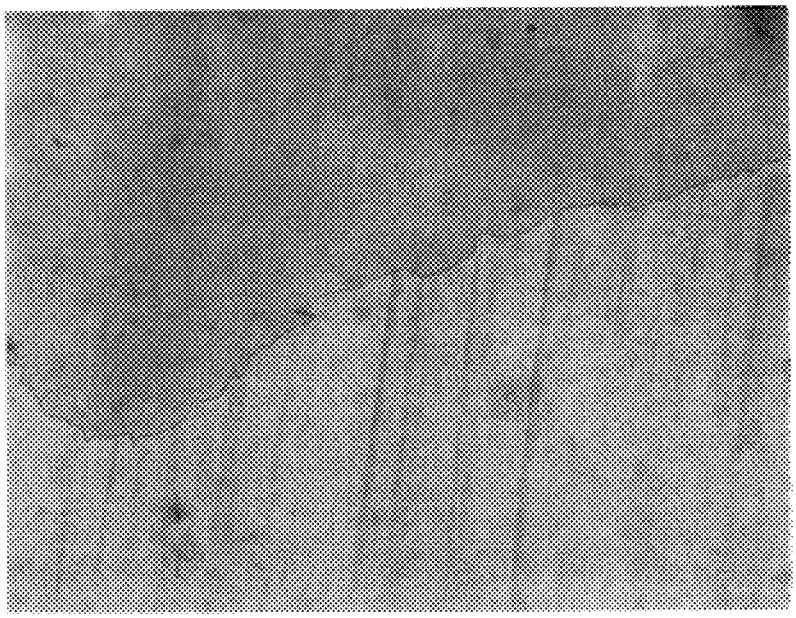
FIG. 5 is a photomicrograph of a casting at 100 magnification from heat #19131K, not made in accordance with the present invention.
Figure 6:
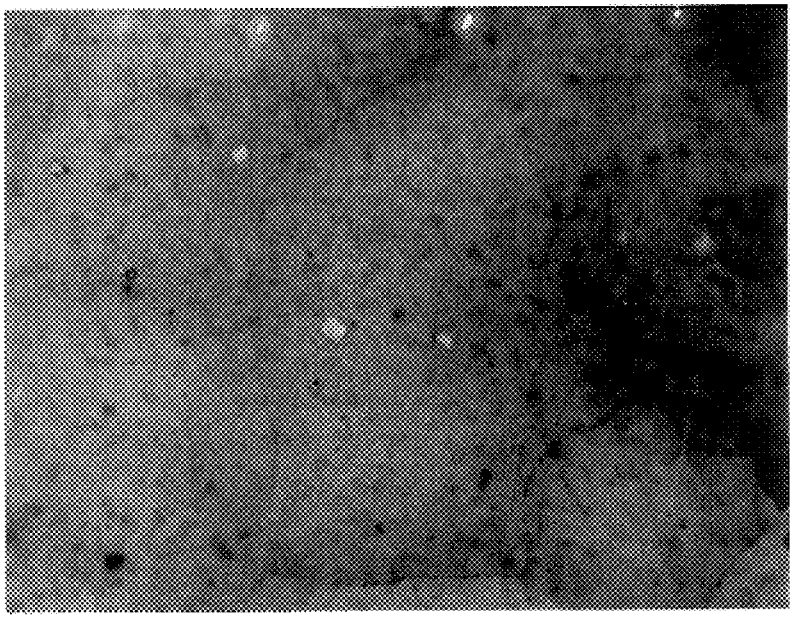
FIG. 6 is a photomicrograph at 200 magnification showing the titanium nitride particles distributed through the microstructure of an alloy of the present invention.

Each of the above alloys are illustrative of the importance of the composition on obtaining the beneficial grain size of the present invention. The inclusion of the grain refiners V and Ti within the required ranges is fundamental to obtaining the beneficial grain size required to achieve the improvements of the present invention. FIG. 5 is illustrative of an untreated casting at 100 magnification that did not include the grain refining elements V and Ti required by the present composition. As is evident, the grain size of the alloy in FIG. 5 is significantly larger than the grain size of the refined alloys of FIGS. 1–4. FIG. 6 is a photomicrograph of an alloy made in accordance with the present invention at 200 magnification, having the refined grain size, but further magnified to illustrate the precipitates within the microstructure that are characteristic for the microalloyed steel of the present invention. Precipitates are uniformly dispersed throughout the grain. The precipitates that geometrically appear to be cubic or angular in nature and appear to be white in FIG. 6, under a microscope, actually are yellowish orange and are the characteristic titanium carbonitride precipitates of the present invention.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. A cast austenitic manganese steel comprising, in weight percentages:

about 11.0% to 24.0% manganese;

about 1.0% to 1.4% carbon;

up to about 1% silicon;

up to about 1.9% chromium;

up to about 0.25% nickel;

up to about 1.0% molybdenum;

up to about 0.2% aluminum;

up to about 0.25% copper;

phosphorus up to about 0.07% max.;

sulfur up to about 0.06% max.;

microalloying additions of titanium in amounts from about 0.020–0.070%;

microalloying additions of vanadium in amounts from about 0.020–0.070%;

nitrogen in amounts from about 100 to 1000 ppm, such that a total amount of the microalloying additions of titanium+vanadium+nitrogen is no less than about 0.05% and no greater than about 0.22%, a ratio of carbon to microalloying additions being in a range of about 10:1–25:1;

the balance of the steel being essentially iron; and the steel characterized by a substantial absence of zirconium and the presence of titanium carbonitride precipitates.

2. The steel of claim 1 further characterized by a grain size of ASTM E112 #1 and finer.

3. The steel of claim 1 wherein the titanium carbonitride precipitates are distributed substantially uniformly within the grains.

4. The steel of claim 1 further including microalloying additions of additional carbide-forming elements in amounts from about 0.020–0.70%.

5. An austenitic manganese steel crusher component for use with aggregates comprising, in weight percentages:

about 11.0% to 24.0% manganese;

about 1.05% to 1.35% carbon;

up to about 1% silicon;

up to about 1.9% chromium;

up to about 0.25% nickel;

up to about 1.0% molybdenum;

up to about 0.2% aluminum;

up to about 0.25% copper;

phosphorus up to about 0.07% max.;

sulfur up to about 0.06% max.;

microalloying additions of titanium in amounts from about 0.020–0.70%;

microalloying additions of vanadium in amounts from about 0.020–0.70%;

nitrogen in amounts from about 100 to 1000 ppm, such that the total amount of the microalloying additions of titanium+vanadium+nitrogen is no less than about 0.05% and no greater than about 0.22%, a ratio of carbon to microalloying additions being in a range of about 10:1–25:1;

the balance of the steel being essentially iron; and the steel characterized by a substantial absence of zirconium and the presence of titanium carbonitride precipitates.

6. The crusher of claim 5 wherein the optional carbide-forming elements includes niobium.

7. The crusher component of alloy of claim 5 further characterized by a grain size of ASTM E112 #2 and finer.

8. The crusher component of claim 5 wherein the titanium carbonitride precipitates are distributed substantially uniformly.

9. The crusher component of claim 5 wherein the component is a bowl liner.

10. The crusher component of claim 5 wherein the component is a mantle.

11. The crusher component of claim 5 characterized by an improved wear of up to 40% over austenitic manganese steel crusher components having a grain size larger than ASTM E112 #2 that do not include titanium carbonitride precipitates.

12. A cast austenitic manganese steel comprising, in weight percentages:

about 11.0% to 14.0% manganese;

about 1.00% to 1.30% carbon;

up to about 1% silicon;

up to about 1.9% chromium;

up to about 0.25% nickel;

up to about 1.0% molybdenum;

up to about 0.2% aluminum;

up to about 0.25% copper;

phosphorus up to about 0.07% max.;

sulfur up to about 0.06% max.;

microalloying additions of optional carbide forming elements in amounts of about 0.035–0.060%;

microalloying additions of titanium in amounts of 0.035–0.060%;

microalloying additions of vanadium in amounts from about 0.035–0.060%;

nitrogen in amounts from about 100 to about 1000 ppm;

a total amount of the microalloying additions of optional carbide forming elements+vanadium+titanium+nitrogen being no less than about 0.08% and no greater than about 0.22%;

a ratio of carbon to microalloying additions being in a range of about 10.7:1–16.6:1;

the balance of the steel being essentially iron; and the steel characterized by a grain size of ASTM-E112 #1 and finer, and a substantial absence of zirconium and a uniform distribution of titanium carbonitride precipitates.

13. The steel of claim 12 wherein the optional carbide forming elements include niobium.

14. The steel of claim 12 further characterized by a substantial absence of zirconium and the presence of titanium carbonitride precipitates.

15. The steel of claim 12 further characterized by a grain size of ASTM E112 #2 and finer.

16. The steel of claim 12 further including carbon in a range of about 1.05–1.35%.

17. The steel of claim 12 further including vanadium in a range of about 0.04–0.06%.

18. The steel of claim 12 further including titanium in the range of about 0.04–0.06%.

19. The steel of claim 12 further including manganese in a range of about 12.5–13.5%.

20. The steel of claim 12 further including at least about 0.01% aluminum.

21. The steel of claim 12 further including about 300 ppm nitrogen.

22. A cast austenitic manganese steel comprising, in weight percentages:

about 11.0% to 14.0% manganese;

about 1.05% to 1.35% carbon;

up to about 1% silicon;

up to about 1.9% chromium;

up to about 0.25% nickel;

up to about 1.0% molybdenum;

up to about 0.2% aluminum;

up to about 0.25% copper;

phosphorus up to about 0.07% max.;

sulfur up to about 0.06% max.;

microalloying additions of titanium in amounts of about 0.035–0.060%;

microalloying additions of vanadium in amounts of about 0.035–0.060%;

nitrogen up to about 1000 ppm;

microalloying additions of zirconium such that, on an atomic basis, nitrogen minus zirconium is between about 100 ppm and 1000 ppm;

a total amount of the microalloying additions of vanadium+titanium+zirconium+nitrogen being no less than about 0.08% and no greater than about 0.22%;

a ratio of carbon to microalloying additions being in the range of about 10.7:1–16.6:1; and the balance of the steel being essentially iron.

23. The steel of claim 22 further characterized by the presence of titanium carbonitride precipitates and zirconium nitride precipitates, and having a grain size of ASTM E112 #1 and finer.

24. The steel of claim 12 further including microalloying additions of additional carbide forming element in amounts of about 0.035–0.060%.

25. A method of manufacturing a cast austenitic manganese steel having improved wear resistance comprising the steps of:

preparing a predetermined charge of manganese steel scrap, carbon steel scrap, ferroalloy additions, silicomanganese and nitrogen-bearing ferrous alloys;

placing the predetermined charge in a furnace of sufficient size to contain the charge;

melting the charge in the furnace while adding slag by sufficient slag additions of lime and coke breeze;

adjusting the composition of the furnace charge during melting to achieve an austenitic manganese steel having a calculated composition comprising, in weight percentages:

about 11.0% to 24.0% manganese;

about 1.0% to 1.4% carbon;

up to about 1% silicon;

up to about 1.9% chromium;

up to about 0.25% nickel;

up to about 1.0% molybdenum;

up to about 0.2% aluminum;

up to about 0.25% copper;

phosphorus up to about 0.07% max.;

sulfur up to about 0.060% max.;

nitrogen in amounts from about 100 to 1000 ppm, the balance of the steel being essentially iron; then heating the molten steel to a temperature in the range of 2670–2900° F., then refining the molten steel by injecting oxygen into it; then deoxidizing the molten steel by addition of deoxidants; then adjusting the temperature in the furnace;

pouring the molten steel from the furnace to a preheated ladle;

adding lime to the ladle to form a protective slag;

adding preweighed microalloying elements of vanadium, titanium and carbide forming elements to the molten steel to achieve an amount of about 0.020–0.70% titanium and about 0.020–0.070 vanadium in the steel and such that a total amount the microalloying elements of titanium+vanadium+nitrogen is no less than about 0.05% and no greater than about 0.018%;

holding the steel in the ladle until a temperature in the range of 2590–2660° F. is achieved; and then casting the molten steel into a mold of predetermined shape.

26. The method of claim 25 further including an additional step of deoxidizing the molten steel by adding a predetermined amount of aluminum to the preheated ladle as molten steel is poured from the furnace to the preheated ladle and before about 40% of the ladle is filled.

27. The method of claim 25 wherein the step of adding the pre-weighed microalloying elements to the molten steel includes injecting microalloying additions of ferro-vanadium and ferro-titanium directly into the stream of molten steel as the molten steel is poured from the furnace into the ladle after about 25% –33% of the molten steel charge is poured into the ladle.

28. The method of claim 25 wherein the vanadium and titanium microalloying elements are added to the molten steel as ferrovanadium and ferrotitanium.

29. The method of claim 25 wherein the step of placing the predetermined charge in a furnace of sufficient size to contain the charge includes placing the predetermined charge into an electric arc furnace.

30. The method of claim 25 wherein the predetermined charge weighs up to 13 tons.

31. The method of claim 25 wherein the step of holding the molten steel in the ladle further includes holding the molten steel until a temperature in the range of about 2625–2650° F. is reached.

32. The method of claim 31 wherein the step of holding the molten steel in the ladle further includes holding the molten steel until a temperature of about 2630° F. is achieved.

33. The method of claim 25 further including the step of adding CaSiBa compound as molten steel is poured from the furnace to the preheated ladle and before about 25% of the molten steel charge is poured into the ladle.

34. The method of claim 25 further including the step of determining the actual chemical composition of the molten steel after deoxidation of the molten steel and before pouring the molten steel into the preheated ladle.

35. The method of claim 34 further including the step of adjusting chemical composition of the molten steel as needed after determining the actual chemical composition of the molten steel, and before pouring the molten steel into the ladle.

* * * * *

UNITED STATES PATENT AND TRADEMARK OFFICE

CERTIFICATE OF CORRECTION

PATENT NO. : 6,572,713 B2 
DATED : June 3, 2003
INVENTOR(S) : Jerzy W. Kucharczyk, Karl R. Funk and Bernd Kos It is certified that error appears in the above-identified patent and that said Letters Patent is hereby corrected as shown below:

Column 2,
Line 31, “amounts of about 0.020-0.70%” should read -- amounts of about 0.020-0.070% --.
Line 33, “from about 0.020-0.70%” should read -- from about 0.020-0.070% --.
Line 34, “amounts from about 0.020-0.70%” should read -- amounts from about 0.020-0.070% --.

Column 5,
Line 25, “in the range of about 0.020-0.70%, preferably” should read
-- in the range of about 0.020-0.070%, preferably --.
Line 51, “0.020-0.70%, preferably” should read -- 0.020-0.070%, preferably --.

Column 8,
Line 45, “Alx0.016%” should read -- Alx0.016% --.

Column 9,
Line 2, “MO-0.1” should read -- MO-0.11% --.

Column 10,
Line 42, “from about 0.020-0.70%” should read -- from about 0.020-0.070% --.
Lines 58 and 60, “about 0.020-0.70%” should read -- about 0.020-0.070% --.

Column 12,
Line 38, “The steel of claim 12” should read -- The steel of claim 22 --.

UNITED STATES PATENT AND TRADEMARK OFFICE

CERTIFICATE OF CORRECTION

PATENT NO. : 6,572,713 B2 
DATED : June 3, 2003
INVENTOR(S) : Jerzy W. Kucharczyk, Karl R. Funk and Bernd Kos It is certified that error appears in the above-identified patent and that said Letters Patent is hereby corrected as shown below:

Column 13,
Line 13, "amount of about 0.020-0.70%" should read -- amount of about 0.020-0.070% --.
Line 14, "about 0.020-0.070" should read -- about 0.020-0.070% --.
Line 17, "about 0.018%" should read -- about 0.18% --.

Signed and Sealed this

Seventh Day of October, 2003

JAMES E. ROGAN
*Director of the United States Patent and Trademark Office*